US012765646B2

(12) United States Patent
Jiang

(10) Patent No.: US 12,765,646 B2
(45) Date of Patent: Oct. 20, 2026

(54) WINDING DEVICE

(71) Applicant: SHENZHEN YOUNING TECHNOLOGY CO., LTD., Guangdong (CN)

(72) Inventor: Xiaohua Jiang, Guangdong (CN)

(73) Assignee: Shenzhen Youning Technology Co., Ltd. (CN)

( * ) Notice: Subject to any disclaimer, the term of this patent is extended or adjusted under 35 U.S.C. 154(b) by 146 days.

(21) Appl. No.: 18/416,272

(22) Filed: Jan. 18, 2024

(65) Prior Publication Data

US 2025/0024919 A1 Jan. 23, 2025

(30) Foreign Application Priority Data

Jul. 21, 2023 (CN) ..... 202310898727.5
Jul. 21, 2023 (CN) ..... 202321926390.6

(51) Int. Cl.
*A43C 11/16* (2006.01)
*A44B 11/06* (2006.01)
*B65H 75/44* (2006.01)

(52) U.S. Cl.
CPC ..... *A44B 11/065* (2013.01); *B65H 75/4431* (2013.01); *A43C 11/165* (2013.01)

(58) Field of Classification Search
CPC ..... A43C 7/00; A43C 11/165; A44B 11/065; B65H 75/4431
See application file for complete search history.

(56) References Cited

FOREIGN PATENT DOCUMENTS

| | | | |
|---|---|---|---|
| CN | 201389577 Y | | 1/2010 |
| CN | 216471601 U | | 5/2022 |
| CN | 114735548 A | | 7/2022 |
| CN | 218960176 U | * | 5/2023 |
| CN | 220364187 U | | 1/2024 |

(Continued)

OTHER PUBLICATIONS

Cn 218960176 translation (Year: 2025).*

(Continued)

*Primary Examiner* — Jason W San
*Assistant Examiner* — Michael S Lee
(74) *Attorney, Agent, or Firm* — Barnes & Thornburg LLP

(57) ABSTRACT

Winding device includes fixing member, reel, knob, connecting member, limiting component, and fastener. Fixing member is provided with check portion; toggle portion is provided at end of reel away from housing; first clamping member and linkage portion cooperating with check portion are provided at side of knob facing fixing member. Connecting member is connected to reel and provided with second clamping member cooperating with first clamping member at outer periphery. Limiting component includes guide member and elastic member. Guide member is provided with cooperation portion mating with toggle portion at one end close to housing. Multiple guide grooves are circumferentially formed along inner wall of hole with the largest aperture of stepped hole. Guide clamping structure is formed between two adjacent guide grooves. Elastic member abuts between fixing member and knob. Guide member is movably passed through stepped hole. Clamping slider is provided along circumferential direction of guide member.

16 Claims, 10 Drawing Sheets

(56) References Cited

FOREIGN PATENT DOCUMENTS

WO 2014/197721 A2 12/2014

OTHER PUBLICATIONS

Notification of Grant Patent Right for Invention of priority document CN2023219263906 (Dec. 8, 2023).
First Office Action issued in CN 202310898727.5 (Sep. 21, 2025).
First search of priority document CN2023108987275 (Sep. 20, 2025).

* cited by examiner

WINDING DEVICE

CROSS-REFERENCE TO RELATED APPLICATIONS

The present U.S. utility patent application claims priority to Chinese patent application No. 2023219263906 filed with the Chinese Patent Office on Jul. 21, 2023, and Chinese patent application No. 2023108987275 filed with the Chinese Patent Office on Jul. 21, 2023, the entire contents of each of which is incorporated herein by reference in its entirety.

TECHNICAL FIELD

The present disclosure relates to the technical field of winding device, and in particular to a winding device (or a cord receiver).

BACKGROUND TECHNOLOGY

A winding device is a device that has the function of winding and unwinding cords, and is generally used in shoes, hats, and other scenarios that require tightening and loosening by means of cords and the like. For example, when it is used on shoes, it is generally mounted on the tongue or the side of the shoe and the shoelace passes through the winding device, which makes the shoelace tightened and released through the winding and unwinding function of the winding device, thereby realizing tightening or loosening of the shoelace.

Existing winding devices generally include a reel for winding cord, a knob device transmissively connected to the reel, and a limiting device and a check disk placed between the reel and the knob device. When in use, the knob device needs to be pulled up to realize that both the reel and the check disk are unlocked from the knob device. This makes it hard for children, the elderly, or operators wearing gloves to pull up the knob device, making it difficult to operate and not easy to use.

SUMMARY

In view of the above, the purpose of the present disclosure is to overcome the deficiencies in the prior art and to provide a winding device.

In order to solve above-mentioned problems, the present disclosure provides:

a winding device, including:

a housing;

a fixing member, connected to the housing, wherein the fixing member is provided with a through cavity with two openings at both ends, wherein an elastic arm is provided at the end of the fixing member away from the housing, and the circumferential edge of the elastic arm is provided with a check portion;

a reel for winding cord, wherein the reel is rotatable in axial direction and provided in the through cavity, and a toggle portion is provided at one end of the reel away from the housing;

a knob, wherein a linkage portion and a first clamping member is provided on the side of knob towards the fixing member, and the linkage portion cooperates with the check portion;

a connecting member, connected to one end of the reel away from the housing, wherein the outer circumference of the connecting member is provided with a second clamping member that matches the first clamping member;

a limiting component, wherein the limiting component includes a guide member and an elastic member; a stepped hole is provided on the inner periphery of the connecting member; the end of the guide member close to the housing is provided with a cooperation portion that matches the toggle portion; multiple guide grooves are defined and formed along the circumferential direction of the inner wall of the hole with the largest aperture of the stepped hole; and a guide clamping structure is formed between two adjacent guide grooves, wherein the elastic member abuts between the fixing member and the knob, the guide member is movably passed through the stepped hole, and a clamping slider is provided along the circumferential direction of the guide member; and a fastener, wherein the fastener is passed through the guide member to connect with the knob, wherein when the knob is being pressed, the clamping slider slides out of the guide groove, and the cooperation portion abuts against the toggle portion to rotate the guide member within the stepped hole under the action of the toggle portion, such that the clamping slider engages with the guide clamping structure, and the first clamping member engages with the second clamping member; the knob is pressed again, so as to rotate the guide member within the stepped hole under the action of the toggle portion, such that the clamping slider slides from the clamping structure into the guide groove, and the first clamping member is separated from the second clamping member.

In some embodiments of the present disclosure, multiple oblique teeth are provided at intervals along the circumferential direction of the guide member, wherein the multiple oblique teeth form the clamping slider, and the toggle portion is provided with a first toothed edge, wherein the cooperation portion is provided with a second toothed edge that mates with the first toothed edge.

In some embodiments of the present disclosure, the guide clamping structure is a step-like structure, and the step-like structure comprises a first step surface and a second step surface, wherein the first step surface and the second step surface are inclined surfaces respectively, and are inclined in the same direction as the oblique teeth respectively.

In some embodiments of the present disclosure, the first toothed edge and the reel are made by integral injection molding.

In some embodiments of the present disclosure, the reel is provided with a first clamping part at an end of the reel away from the housing, and the connecting member is provided with a second clamping part that is snapped with the first clamping part at the end of the connecting member close to the housing.

In some embodiments of the present disclosure, the fixing member is provided with a third clamping part at the end close to the housing, and the housing is provided with a fourth clamping part that is snapped with the third clamping part.

In some embodiments of the present disclosure, the elastic arm and the fixing member are made by integral injection molding.

In some embodiments of the present disclosure, the side of knob close to the housing is protrudingly provided with a mounting column, wherein the mounting column is provided with a first mounting hole, the guide member is provided with a second mounting hole, and the fastener is sequentially passed through the second mounting hole and the first mounting hole, so as to make the guide member tightly connect to the knob.

In some embodiments of the present disclosure, the inner circumference of the end of knob close to the housing is provided with a first limiting portion, and the second limiting portion that cooperates with the first limiting portion is disposed on the outer circumference of one end of the fixing member away from the housing.

In some embodiments of the present disclosure, the reel comprises a reel and a disk body provided at two ends of the reel, wherein a diameter of the disk body is greater than the diameter of the reel. The reel is respectively provided with a first threading hole and a second threading hole along an axis direction perpendicular to the reel, and the fixing member is provided with a first avoiding hole and a second avoiding hole, wherein the first avoiding hole is provided correspondingly to the first threading hole, and the second avoiding hole is provided correspondingly to the second threading hole.

Embodiments of the present disclosure have the following advantages.

The present disclosure proposes a winding device, wherein the winding device comprises a housing, a fixing member, a reel for winding the cord, a knob, a connecting member, a limiting component, and a fastener. The limiting component includes a guide member and an elastic member, wherein the fixing member is connected to the housing and is provided with a through cavity with openings at both ends, and the side of fixing member away from the housing is provided with an elastic arm, wherein a check portion is provided at the circumferential edge of the elastic arm. The reel can be rotatably provided around the axial direction in the through cavity, a toggle portion is provided at the end of the reel away from the housing, and a first clamping member and a linkage portion that cooperates with the check portion are provided on the side of knob toward the fixing member. The connecting member is connected to an end of the reel away from the housing, a second clamping member matching with the first clamping member is provided in an outer circumference of the connecting member, the connecting member is provided with a stepped hole in the inner circumference, and the end of guide member close to the housing is provided with a cooperation portion matching with the toggle portion. Multiple guide grooves are circumferentially defined and formed along the inner wall of the hole with the largest aperture of the stepped hole, wherein a guide clamping structure is formed between two adjacent guide grooves. An elastic member abuts between the fixed member and the knob, the guide member is movably passed through the stepped hole, a clamping slider is disposed along the circumferential direction of the guide member, and a fastener is passed through the guide member and connected to the knob.

In the process of use, such as tightening of the cord, it is only necessary to press the knob once to squeeze and drive the guide member to move synchronously so as to make the clamping slider slide out of the guide groove, and to make the cooperation portion and the toggle portion abut against each other to rotate the guide member in the stepped hole under the action of the toggle portion, thereby making the clamping slider snap with the guide clamping structure, and making the first clamping member snap with the second clamping member. At this time, the elastic member is compressed, and the linkage portion is snapped with the check portion, such that the knob can only be rotated in one of a clockwise direction and a counterclockwise direction. When the knob can only be rotated in a clockwise direction, in this way, the knob can drive the reel to rotate to tighten the cord. If it is necessary to release the cord, on the basis of pressing the knob for the first time, the knob is pressed again, and the cooperation portion abuts against the toggle portion, so as to rotate the guide member in the stepped hole under the action of the toggle portion, and at the same time, by utilizing the reset elasticity generated by the elastic member being compressed, the clamping slider slides from the clamping structure to the guide groove, such that the first clamping member and the second clamping member separate from each other. At this time, the elastic member is reset, the linkage portion and the check portion are snapped together, the reel can rotate freely in the clockwise or counterclockwise direction, and the cord can be loosened from the reel. The loosening and tightening of the cord can be realized by pressing the knob cyclically in sequence, that is to say, the rotational loosening and tightening of the cord can be realized through pressing the knob, which is easy and convenient to operate, thereby avoiding the technical problem of the prior art in which operation is difficult through the knob being pulled up.

In order to make the above purposes, features and advantages of the present disclosure more obvious and understandable, the following preferable embodiments, together with the drawings, are described in detail as follows.

BRIEF DESCRIPTION OF DRAWINGS

In order to more clearly illustrate the technical solutions of the embodiments of the present disclosure, the drawings to be used in the embodiments will be briefly introduced below, and it should be understood that the following drawings only show certain embodiments of the present disclosure, and therefore should not be regarded as a limitation of the scope, and that other relevant drawings can be obtained from these drawings by a person of ordinary skill in the art without inventive effort.

REFERENCE NUMERALS

Figure 1:
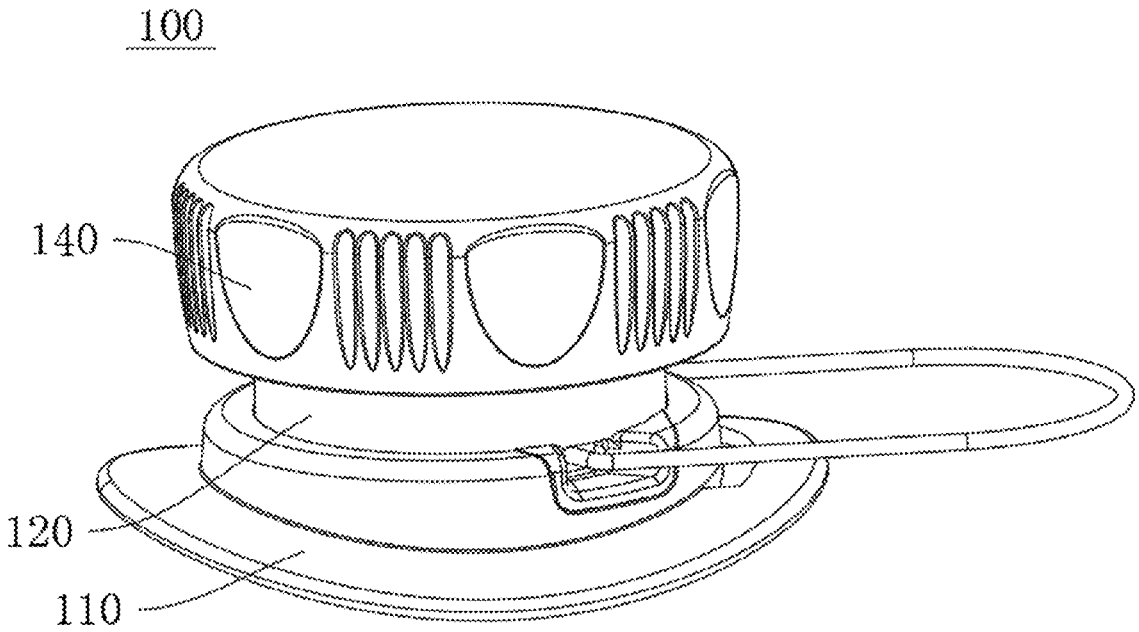
FIG. 1 is a three-dimensional schematic view of a winding device in a released state in some embodiments of the present disclosure.

100—winding device; 110—housing; 111—fourth clamping part; 120—fixing member; 121—through cavity; 122—elastic arm; 1221—check portion; 123—third clamping part; 124—second limiting portion; 125—first avoiding hole; 126—second avoiding hole; 130—reel; 131—toggle portion; 1311—first toothed edge; 132—first clamping part; 133—reel; 1331—first threading hole; 1332—second threading hole; 134—disk body; 140—knob; 141—linkage portion; 142—first clamping member; 143—mounting column; 1431—first mounting hole; 144—first limiting portion; 150—connecting member; 151—second clamping member; 152—stepped hole; 1521—guide groove; 1522—guide clamping structure; 15221—step-like structure; 152211—first step surface; 152212—second step surface; 153—second clamping part; 160—limiting component; 161—guide member; 1611—cooperation portion; 16111—second toothed edge; 1612—clamping slider; 16121—oblique tooth; 1613—second mounting hole; 170—fastener.

DETAILED DESCRIPTION OF EMBODIMENTS

Embodiments of disclosure are described in detail below, and examples of the embodiments are shown in the drawings, wherein the same or similar labeling throughout denotes the same or similar elements or elements having the same or similar function. The embodiments described below by reference to the drawings are exemplary and are intended solely for the purpose of explaining disclosure and cannot to be construed as a limitation of the present disclosure.

It should be noted that when an element is called to be "fixed" to another element, it can be directly on the other element or there can be a centered element. When an element is considered to be "connected" to another element, it can be directly connected to the other element or there can be centered elements at the same time. In contrast, when an element is called to be "directly on" another element, there is no intermediate element. The terms "vertical", "horizontal", "left", "right" and similar expressions are used herein for illustrative purposes only.

In the present disclosure, unless otherwise expressly provided and limited, the terms "mount", "communicate", "connect", "fixe", etc., are to be understood in a broad sense. For example, it can be a fixed connection, a removable connection, or an integration; it can be a mechanical connection, an electrical connection, a direct connection, an indirect connection through an intermediate medium; and it can be a communication within two elements, or an interaction between two elements. For those of ordinary skill in the art, the specific meaning of the above terms in the present disclosure can be understood on a case-by-case basis.

Furthermore, the terms "first" and "second" are used for descriptive purposes only and are cannot be understood as indicating or implying relative importance or implicitly specifying the number of technical features indicated. As a result, a feature defined as "first" or "second" can expressly or implicitly include one or more such features. In the description of the present disclosure, "multiple" means two or more, unless otherwise expressly and specifically limited exist.

Unless otherwise defined, all technical and scientific terms used herein have the same meaning as commonly understood by those of ordinary skill in the art belonging to the present disclosure. The terms used herein in the specification is for the purpose of describing specific embodiments only and is not intended to limit disclosure. As used herein, the term "and/or" includes any and all combinations of one or more of the relevant listed items.

As shown in FIGS. 1, 4, 7, and 8, embodiments of the present disclosure provide a winding device 100, which is mainly used in household items such as shoes, bags, and clothes that have cords that need to be wound or released, wherein the winding device 100 comprises a housing 110, a fixing member 120, a reel 130 for winding the cords, a knob 140, a connecting member 150, a limiting component 160, and a fastener 170.

Referring to FIGS. 2, 3, 5, and 6, the fixing member 120 is connected to the housing 110, wherein the way of connection can be snapping connection, the fixing member 120 is provided with through cavity 121 with openings at both ends, the elastic arm 122 is provided at one end of the fixing member 120 away from the housing 110, and the check portion 1221 is provided on the circumferential edge of the elastic arm 122. The reel 130 is rotatable in the through cavity 121 and disposed in the axial direction, and a toggle portion 131 is provided at the end of the reel 130 away from the housing 110. A linkage portion 141 and a first clamping part 142 are provided on the side of the knob 140 facing the fixing part 120, wherein the linkage portion 141 cooperates with the check portion 1221. The connecting member 150 is connected to the end of the reel 130 away from the housing 110, wherein the way of connection can be a snapping connection, such that the reel 130 and the connecting member 150 can rotate synchronously. The outer circumference of the connecting member 150 is provided with the second clamping member 151 cooperating with the first clamping member 142.

It is noted that the check portion 1221 can be a pawl, and the linkage portion 141 can be an oblique tooth groove 16121 that is capable of engaging with the pawl. The housing 110 can be secured to the tongue of the shoe by rivets and can also be attached to a bag or clothing. The first clamping member 142 is of a protruding structure and the second clamping member 151 is of a slot structure. When the first clamping member 142 is engaged with the second clamping member 151, the knob 140 rotates to drive the connecting member 150 and the reel 130 to synchronously rotate, and the knob 140 can be rotated in one of a counterclockwise or a clockwise direction, but cannot be bidirectionally rotated in a clockwise or a counterclockwise direction.

The limiting component 160 comprises a guide member 161 and an elastic member 162, a stepped hole 152 is provided at the inner periphery of the connecting member 150, and the end of the guide member 161 close to the housing 110 is provided with a cooperation portion 1611 that matches the toggle portion 131. Multiple guide grooves 1521 are circumferentially defined and formed along the inner wall of the hole with the largest aperture of the stepped hole 152, wherein a guide clamping structure 1522 is formed between two adjacent guide grooves 1521 respectively. The elastic member 162 abuts between the fixing member 120 and the knob 140, and the guide member 161 is movably disposed through the stepped hole 152. A clamping slider 1612 is provided along the circumferential direction of the guide member 161, wherein the clamping slider 1612 is capable of sliding inside the guide grooves 1521 and is capable of snapping with the guide clamping structure 1522.

The fastener 170 passes through the guide member 161 to connect to the knob 140, such that guide member 161 is axially fixed to knob 140 and can be rotated circumferentially.

When the knob 140 is pressed, the clamping slider 1612 slides out of the guide groove 1521 and the cooperation portion 1611 abuts against the toggle portion 131 to rotate the guide member 161 within the stepped hole 152 under the action of the toggle portion 131, such that the clamping slider 1612 is snapped with the guide clamping structure 1522 and the first clamping member 142 is snapped with the second clamping member 151, at which point the elastic member is compressed. The knob 140 is pressed again to rotate the guide member 161 within the stepped hole 152 under the action of the toggle portion 131. By utilizing the resetting elastic force generated by the compression of the elastic member to cause the clamping slider 1612 to slide from the clamping structure into the guide groove 1521, wherein the first clamping 142 is separated from the second clamping 151, at which time the elastic member recovers its elastic deformation to an initial position. The initial position is the elastic state of the elastic member before the knob 140 is pressed for the first time.

The embodiment of the present disclosure provides a winding device 100, in the course of use, for example, when tightening a cord, it only needs to press the knob 140 once to squeeze and drive the guide member 161 to move synchronously to make the clamping slider 1612 slide out of the guide groove 1521, and to make the cooperation portion 1611 to be engaged with the toggle portion 131 to rotate the guide member 161 inside the stepped hole 152 by the action of the toggle portion 131, so as to make the clamping slider 1612 to snap with the guide clamping structure 1522. The first clamping member 142 is snapped with the second clamping member 151, at which time, the elastic member is compressed, such that the linkage portion 141 is snapped with the check portion 1221 to enable the knob 140 to be rotated only in one of a clockwise direction or a counterclockwise direction, such as enabling the knob 140 to be rotated only in a clockwise direction, in this way, the knob 140 can drive the reel 130 to rotate to realize tightening of the cord.

When the cord needs to be released, on the basis of the first pressing of the knob 140, the knob 140 is pressed again, the cooperation portion 1611 abuts against the toggle portion 131 in order to rotate the guide member 161 in the stepped hole 152 under the action of the toggle portion 131, and at the same time, by utilizing the reset elasticity generated by the elastic member being compressed, the clamping slider 1612 slides from the clamping structure to the guide groove 1521, and the first clamping member 142 is separated from the second clamping member 151, at which time the elastic member will be reset, and the linkage portion 141 abuts against the check portion 1221. Certainly, in other embodiments, the linkage portion 141 and the check portion 1221 can also be separated from each other. The reel 130 can be freely rotated in the clockwise or counterclockwise direction, and the cord can be released from the reel 130. The loosening and tightening of the cord can be realized by sequentially cyclically operating the knob 140, that is, the rotation and tightening of the cord can be realized by pressing the knob 140. The operation is simple and convenient, and the technical problem of difficult operation caused by pulling up the knob in the prior art is avoided.

As shown in FIGS. 3, 6, 12, and 13, in one embodiment of the present disclosure, optionally, a plurality of oblique teeth 16121 are provided at intervals along the circumferential direction of the guide member 161, the plurality of oblique teeth 16121 form the clamping slider 1612, the toggle portion 131 is provided with a first toothed edge 1311, and the cooperation portion 1611 is provided with a second toothed edge 16111 that mates with the first toothed edge 1311.

In this embodiment, in the process of use, such as tightening the cord, it is only necessary to press the knob 140 once to squeeze and drive the guide member 161 to move synchronously to make the oblique teeth 16121 slide out of the guide groove 1521, and to make the second toothed edge 16111 abut against the first toothed edge 1311 to rotate the guide member 161 within the stepped hole 152 under the action of the first toothed edge 1311, so that the oblique teeth 16121 can be snapped with the guide clamping structure 1522. The first clamping member 142 is snapped with the second clamping member 151, at which time the elastic member is compressed, and the linkage portion 141 is snapped to the check portion 1221, such that the knob 140 can drive the reel 130 to rotate to realize tightening of the cord.

When the cord needs to be released, on the basis of the first pressing of the knob 140, the knob 140 is pressed again, and the second toothed edge 16111 abuts against the first toothed edge 1311 so as to rotate the guide member 161 within the stepped hole 152 under the action of the first toothed edge 1311, and at the same time, by using the reset elasticity generated by the compression of the elastic member, the oblique teeth 16121 slide from the clamping structure to the guide groove 1521. The first clamping member 142 is separated from the second clamping member 151, at which time the elastic member is reset, and the linkage portion 141 is snapped with the check portion 1221. Certainly, in other embodiments, the linkage portion 141 and the check portion 1221 can also be separated, and the reel 130 can freely rotate in either a clockwise or a counterclockwise direction, and the cord can be released from the reel 130.

As shown in FIGS. 3, 6, 11, and 12, in the above embodiment of the present disclosure, optionally, the guide clamping structure 1522 is a step-like structure 15221, and the step-like structure 15221 comprises a first step surface 152211 and a second step surface 152212, wherein the first step surface 152211 and the second step surface 152212 are inclined surfaces and are in the same inclined direction, respectively, as the inclined teeth 16121.

In the embodiment, when the knob 140 is pressed, the knob 140 pushes the oblique teeth 16121 down along the guide groove 1521 to the junction of the guide groove 1521 and the second step surface 152212, at which time the elastic member is compressed to generate an elastic force. After releasing the knob 140, under the elastic force of the elastic member and the action of the first toothed edge 1311, the oblique teeth 16121 move from the junction of the guide groove 1521 and the second step surface 152212 to a position where the second step surface 152212 is close to the first step surface 152211, and is snapped to the position of the second step surface 152212 close to the first step surface 152211, with the elastic member still in a compressed state.

When the knob 140 is pressed again, the knob 140 pushes the oblique teeth 16121 downwardly along the interface between the second step surface 152212 and the first step surface 152211 to the junction of the first step surface 152211 and the second step surface 152212, and the elastic member is still in the state of compression. After releasing the knob 140, under the resetting elasticity of the elastic member and the action of the first toothed edge 1311, the oblique teeth 16121 move from the junction of the first step surface 152211 and the second step surface 152212 to the first step surface 152211, and move along the first step surface 152211 to the guide groove 1521 to return to the initial position.

In the above embodiment of the present disclosure, optionally, the first toothed edge 1311 and the reel 130 are made by integral injection molding.

In this embodiment, by integrally injection molding of the first toothed edge 1311 and the reel 130, this not only improves the stability of the connection between the toggle portion 131 and the reel 130, but also makes the structure compact, thereby improving the utilization of space, and being conducive to reducing the overall thickness of the winding device 100. At the same time, integral injection molding further eliminates the installation step of mounting the toggle portion 131 to the reel 130, thereby improving the overall installation efficiency of the winding device 100.

Figure 12:
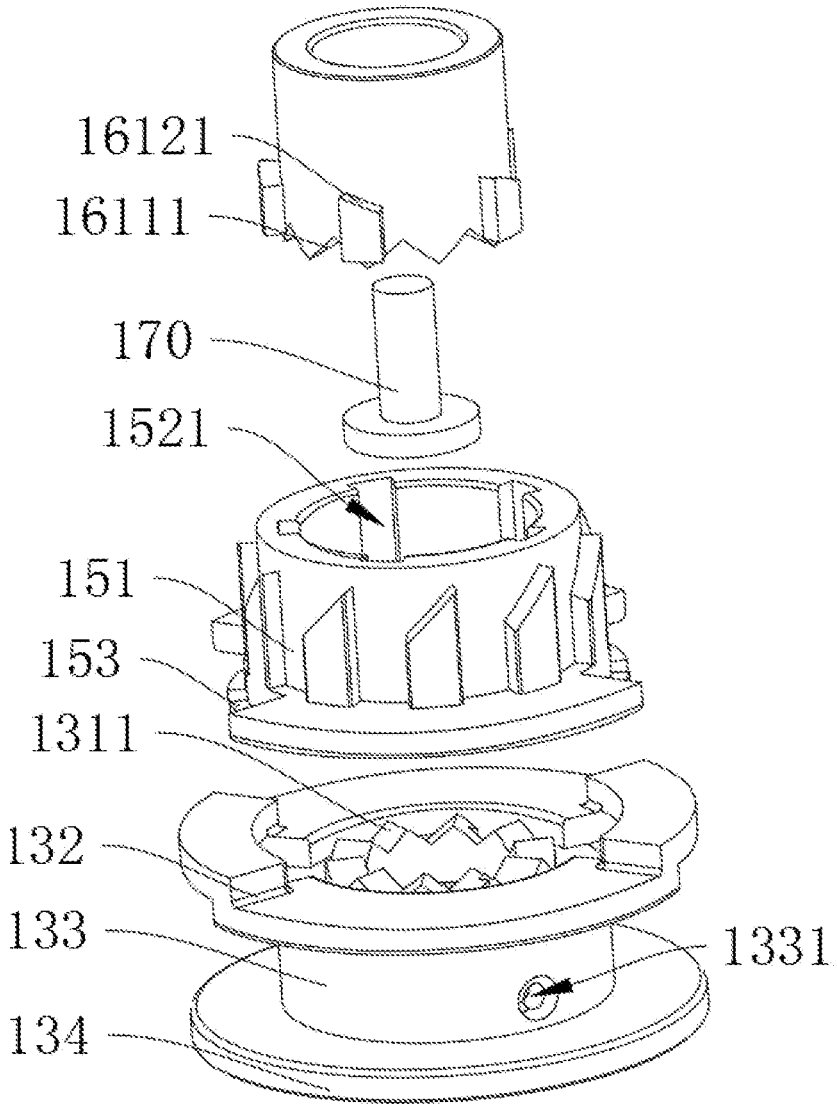
FIG. 12 is the exploded schematic view of the guide member, connecting member, and reel in some embodiments of the present disclosure at one angle of view.

As shown in FIG. 12, in one embodiment of the present disclosure, optionally, the reel 130 is provided with a first clamping part 132 at the end of the reel away from the housing 110, and the end of the connecting member 150 close to the housing 110 is provided with a second clamping part 153 that engages with the first clamping part 132.

In this embodiment, by providing a first clamping part 132 at an end of the reel 130 away from the housing 110, and a second clamping part 153 that is snapped with the first clamping part 132 at an end of the connecting member 150 close to the housing 110, the reel 130 and the connecting member 150 are fixedly connected as a whole. Therefore, the reel 130 and the connecting member 150 can be synchronously and stably rotated.

Exemplarily, the first clamping part 132 can be a snap-fit, and the second clamping part 153 can be a groove that fits to the snap-fit; or the first clamping part 132 can be a groove, and the second clamping part 153 can be a snap-fit that fits to the groove.

Figure 10:
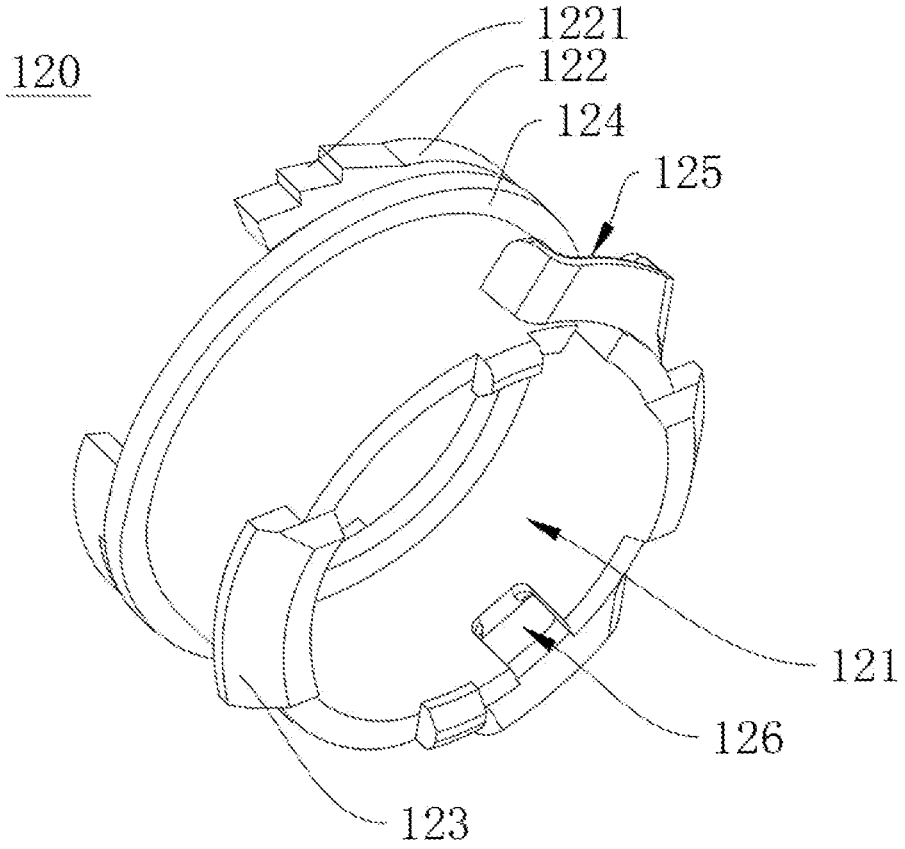
FIG. 10 is a three-dimensional schematic view of a fixing member in some embodiments of the present disclosure.
Figure 11:
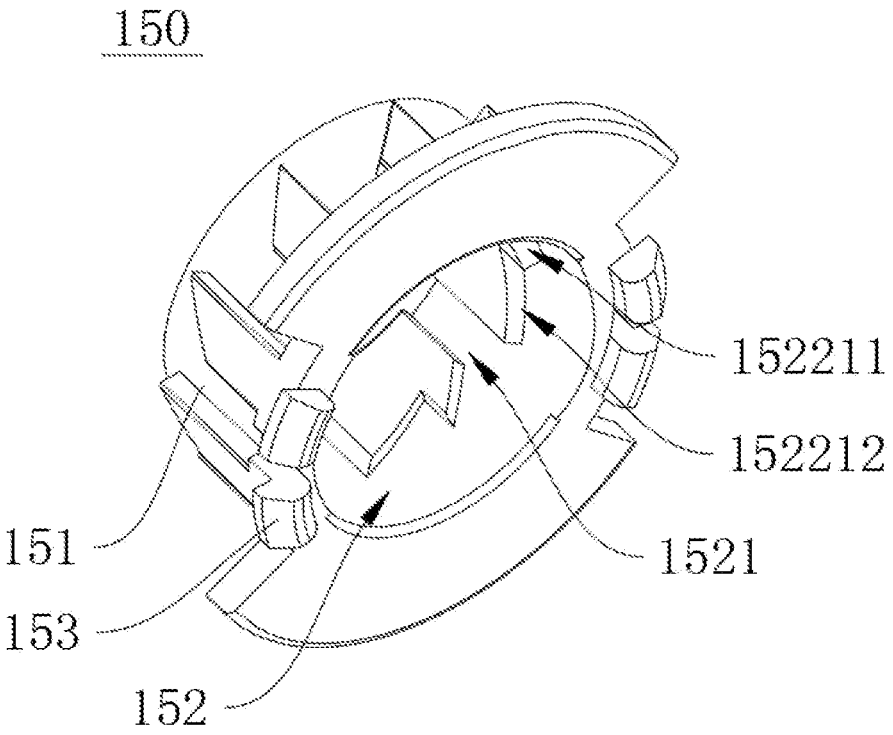
FIG. 11 is a three-dimensional schematic view of a connecting member in some embodiments of the present disclosure.
Figure 14:
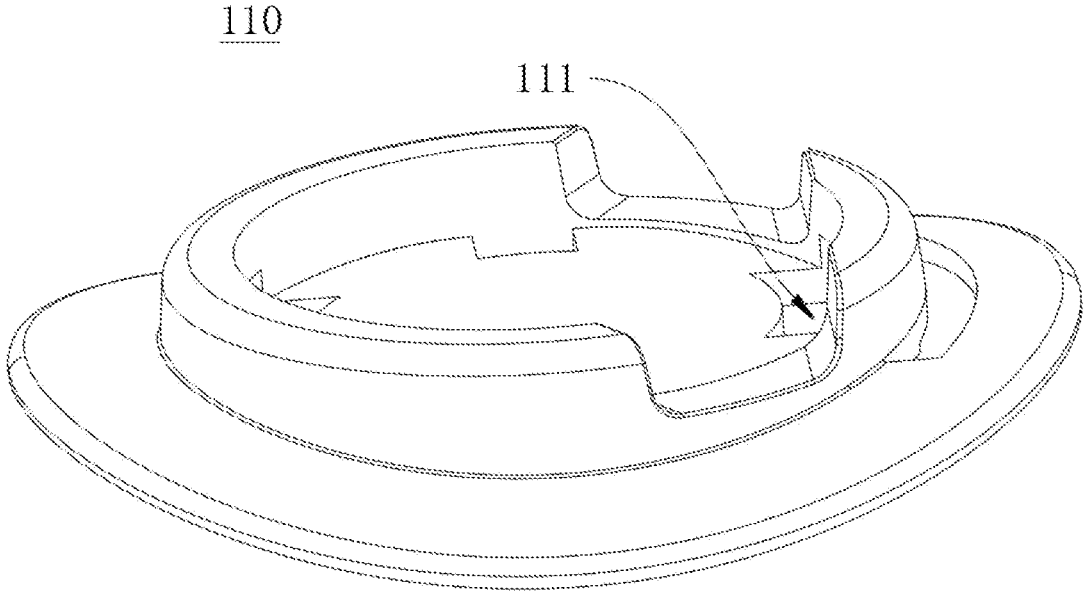
FIG. 14 is a three-dimensional schematic view of the housing in some embodiments of the present disclosure.

As shown in FIGS. 10 and 14, in one embodiment of the present disclosure, optionally, the fixing member 120 is provided with a third clamping part 123 at an end close to the housing 110, and the housing 110 is provided with a fourth clamping part 111 that is snapped to the third clamping part 123.

In this embodiment, by providing a third clamping part 123 at an end of the fixing member 120 close to the housing 110, and a fourth clamping part 111 that is snapped to the third snap portion 123 on the housing 110, the fixing member 120 is mounted stably on the housing 110, thereby realizing the function of solidly mounting the fixing member 120.

Illustratively, the third clamping part 123 can be a snap-fit, and the fourth clamping part 111 can be a groove that fits to the snap-fit; or the third clamping part 123 can be a groove and the fourth clamping part 111 can be a snap-fit that fits to the groove.

In one embodiment of the present disclosure, optionally, the elastic arm 122 and the fixing member 120 are made by integral injection molding.

In this embodiment, by integral injection molding of the elastic arm 122 and the fixing member 120, this not only can improve the stability of the connection between the elastic arm 122 and the fixing member 120, but also makes the structure compact, thereby improving the utilization of space, and being conducive to reducing the overall thickness of the winding device 100. At the same time, integral injection molding can eliminate the installation step of mounting the elastic arm 122 on the fixing member 120, thereby improving the overall installation efficiency of the winding device 100.

Figure 6:
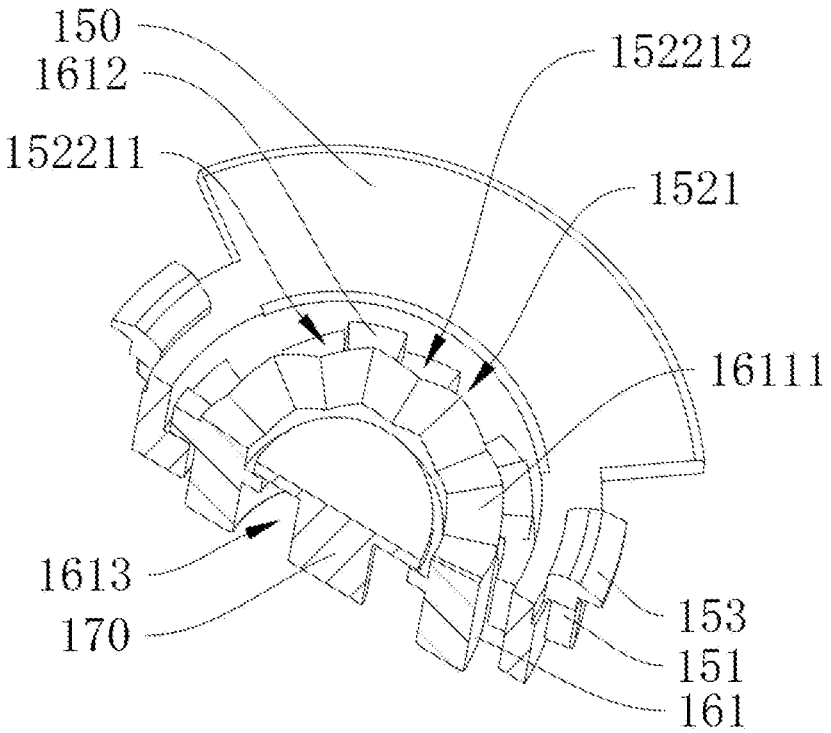
FIG. 6 is a sectional schematic view of the connecting member and the guide member in a clamped state in some embodiments of the present disclosure.
Figure 7:
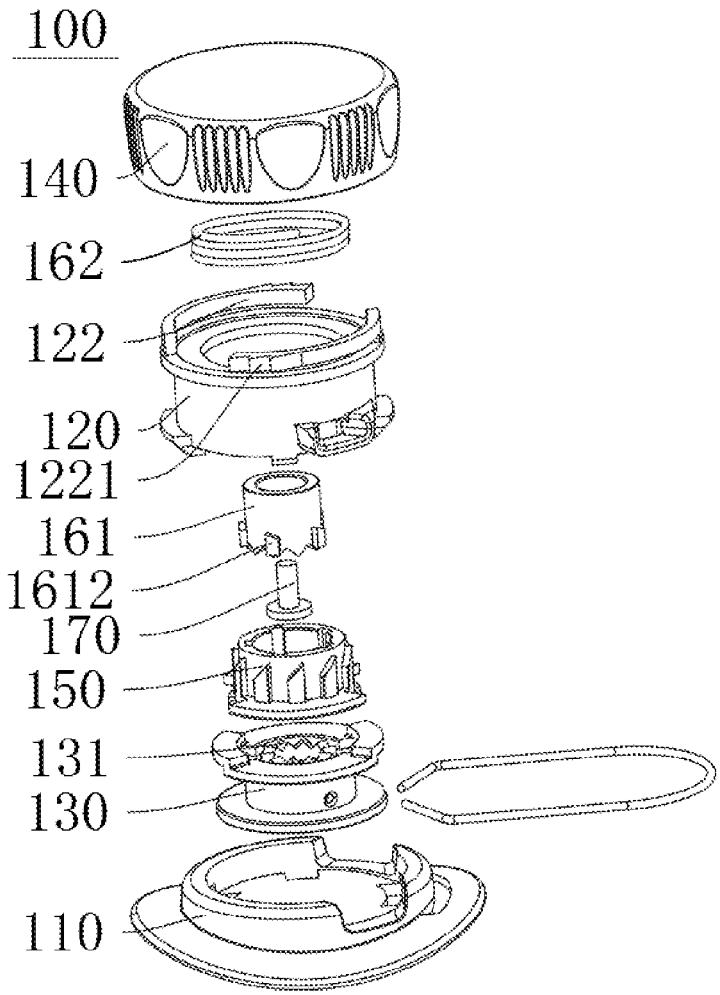
FIG. 7 is the exploded schematic view of a winding device in some embodiments of the present disclosure at one angle of view.
Figure 8:
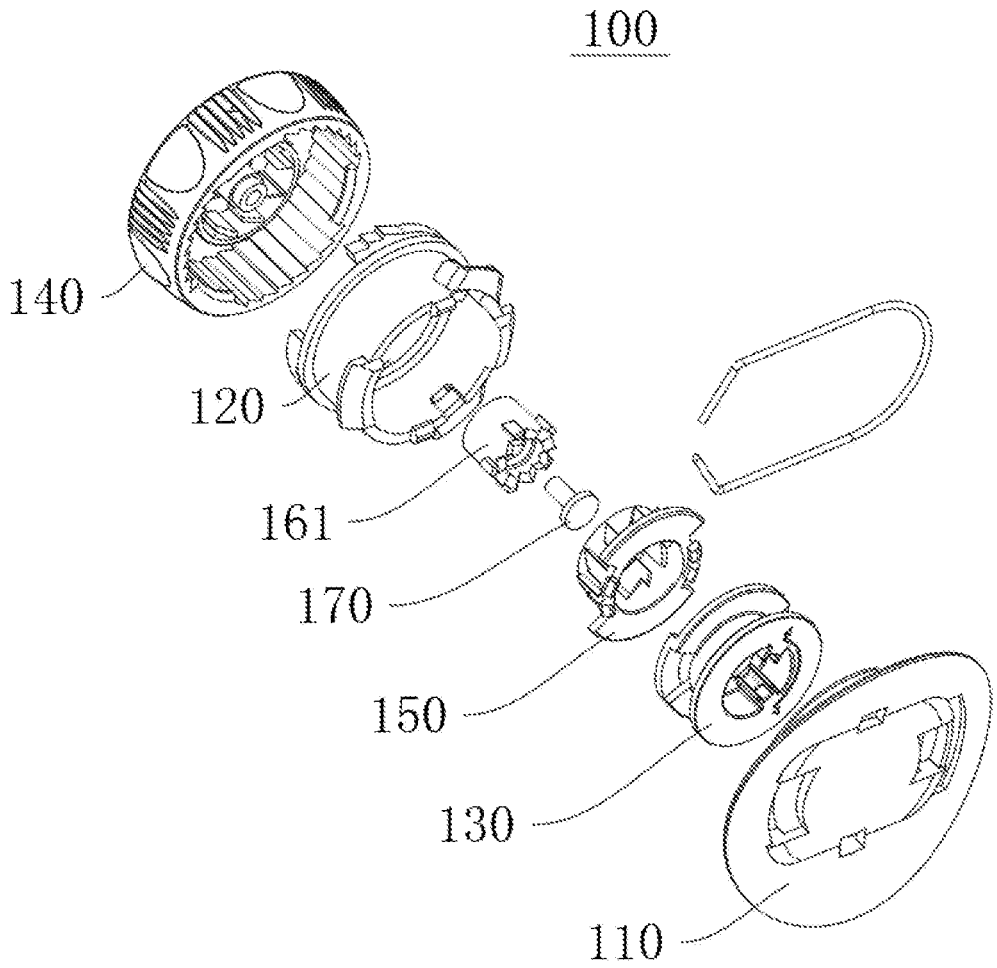
FIG. 8 is the exploded schematic view of a winding device in some embodiments of the present disclosure at another angle of view.
Figure 9:
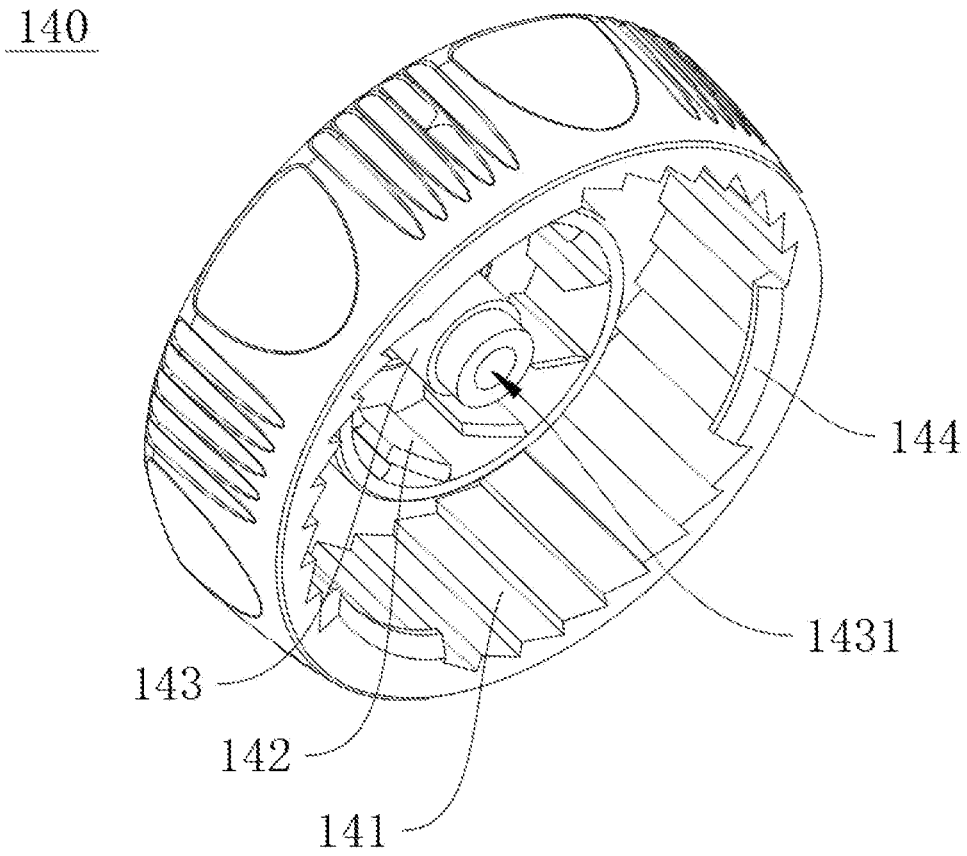
FIG. 9 is a three-dimensional schematic view of the knob in some embodiments of the present disclosure.
Figure 13:
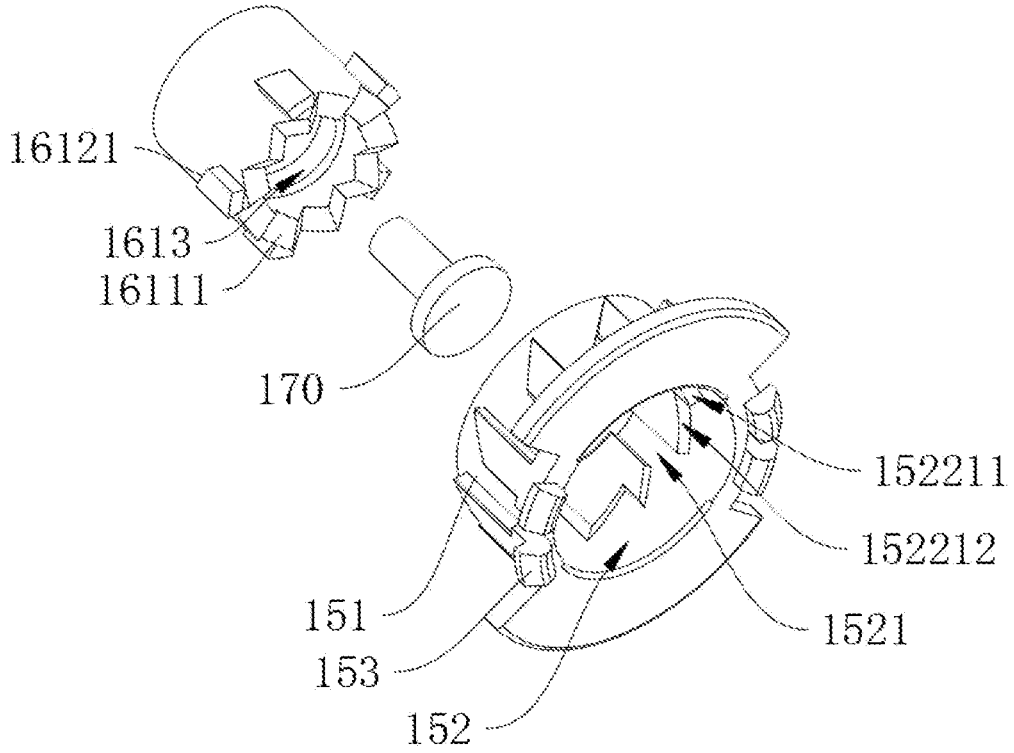
FIG. 13 is the exploded schematic view of the guide member, connecting member, and reel in some embodiments of the present disclosure at another angle of view.

As shown in FIG. 6, FIG. 9 and FIG. 13, in one embodiment of the present disclosure, optionally, the knob 140 is provided with a mounting column 143 protruding from the side of the knob 140 close to the housing 110, wherein the mounting column 143 is provided with a first mounting hole 1431, and the guide member 161 is provided with a second mounting hole 1613, and the fastener 170 is sequentially passed through the second mounting hole 1613 and the first mounting hole 1431, so as to tightly connect the guide member 161 to the knob 140.

In this embodiment, the mounting column 143 is provided by protruding from the side of the knob 140 near the housing 110, a first mounting hole 1431 is provided on the mounting column 143, and a second mounting hole 1613 is provided on the guide member 161, such that the fastener 170 can be passed through the second mounting hole 1613 and the first mounting hole 1431 in sequence, so that the guide member 161 is tightly connected to the knob 140, and thereby the guide member 161 is axially fixed to the knob 140 and can be rotated circumferentially.

Exemplarily, the fastener 170 can be screws, the first mounting hole 1431 can be screw hole that fits to the screw, and the second mounting hole 1613 can be stepped mounting hole.

As shown in FIGS. 9 and 10, in one embodiment of the present disclosure, optionally, the knob 140 is provided with a first limiting portion 144 on the inner circumference of one end close to the housing 110, and the second limiting portion 124 matched with the first limiting portion 144 is provided at the outer circumference of one end of the fixing member 120 away from the housing 110.

In this embodiment, the first limiting portion 144 is provided on the inner circumference of the end of the knob 140 close to the housing 110, and the second limiting portion 124 cooperating with the first limiting portion 144 is provided on the outer circumference of the end of the fixing member 120 away from the housing 110, so as to play a role in limiting the position of the knob 140, thereby preventing the knob 140 from falling off from the fixing member 120.

Exemplarily, the first limiting portion 144 can be a limiting clasp, and the second limiting portion 124 can be an annular projection that cooperates with the limiting clasp.

Figure 2:
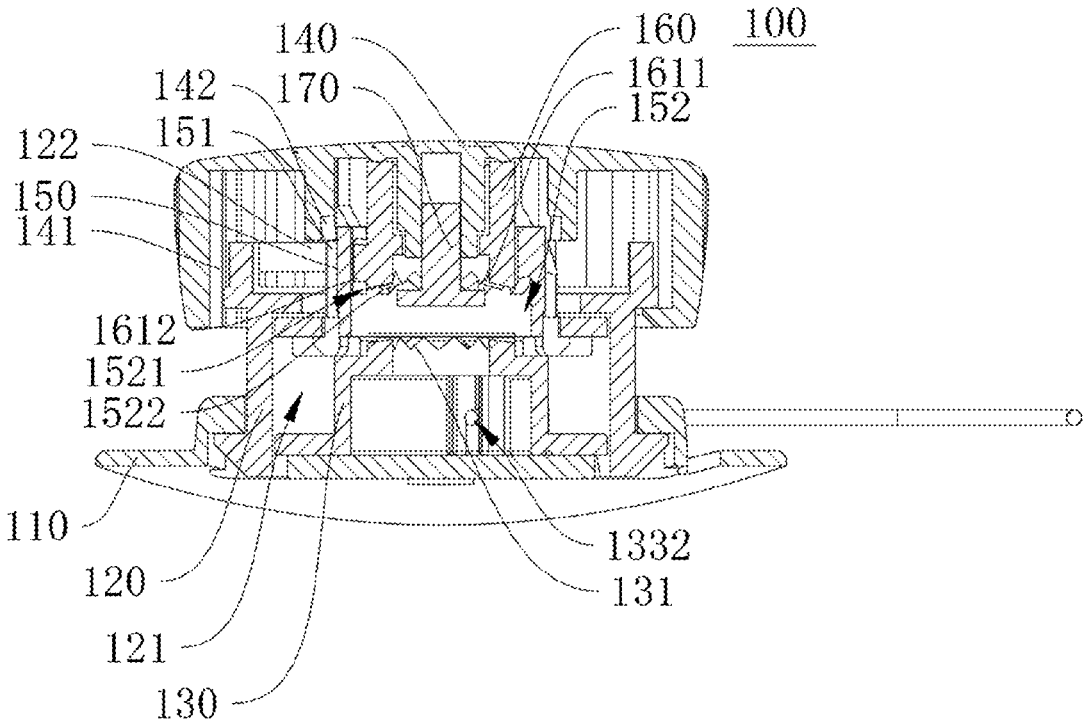
FIG. 2 is a sectional schematic view of a winding device in a released state in some embodiments of the present disclosure.
Figure 3:
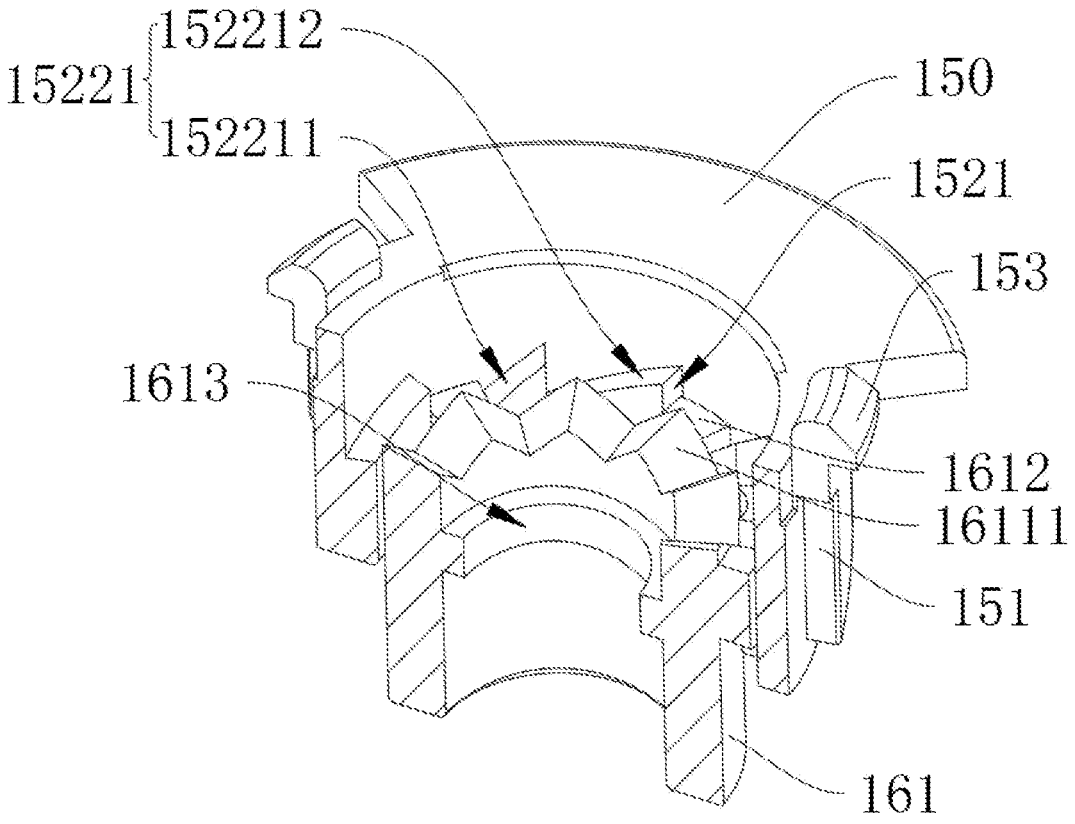
FIG. 3 is a sectional schematic view of the connecting member and guide member in a released state in some embodiments of the present disclosure.
Figure 4:
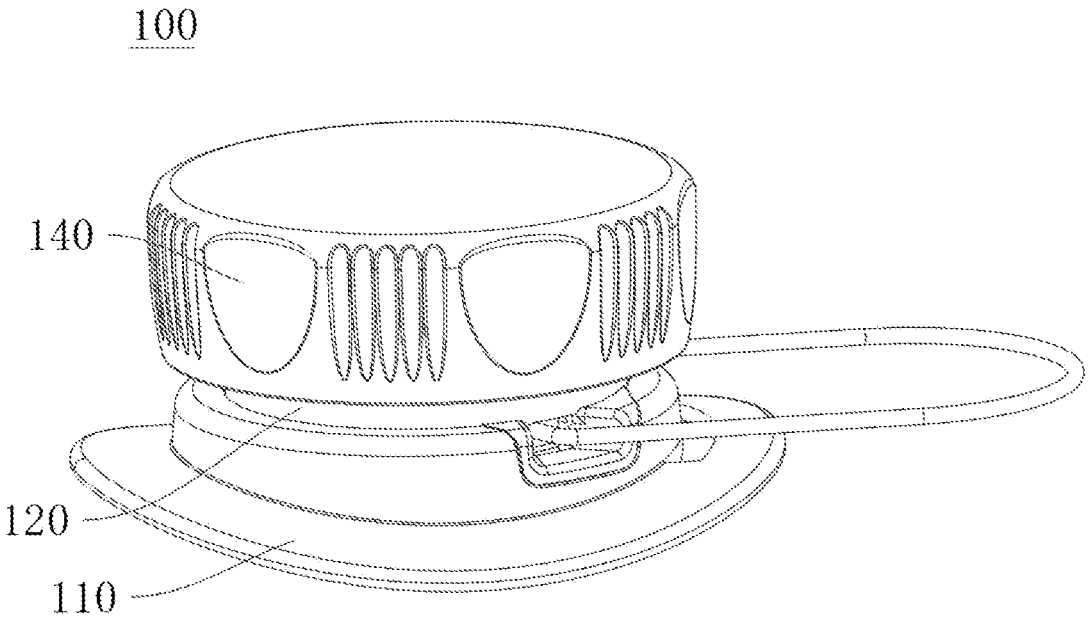
FIG. 4 is a three-dimensional schematic view of a winding device in a clamped state in some embodiments of the present disclosure.
Figure 5:
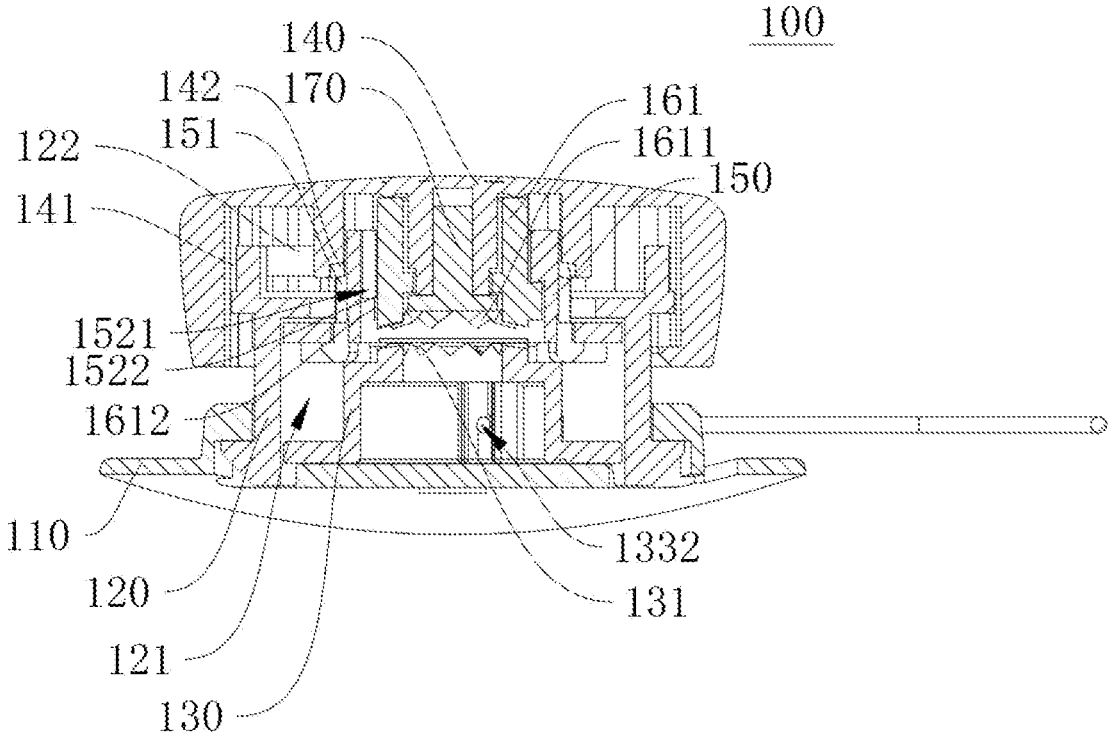
FIG. 5 is a sectional schematic view of a winding device in a clamped state in some embodiments of the present disclosure.

As shown in FIGS. 2, 10, and 12, in one embodiment of the present disclosure, optionally, the reel 130 comprises a reel 133 and a disk body 134 disposed at both ends of the reel 133, wherein the disk body 134 has a diameter greater than the diameter of the reel 133. The reel 133 is respectively provided with a first threading hole 1331 and a second threading hole 1332 along the direction perpendicular to the axis of reel 133. The fixing member 120 is provided with a first avoidance hole 125 and a second avoidance hole 126, wherein the first avoidance hole 125 is provided correspondingly to the first threading hole 1331, and the second avoidance hole 126 is provided correspondingly to the second threading hole 1332.

In this embodiment, one end of the cord can be sequentially passed through the first avoidance hole 125 and the first threading hole 1331 to be knotted and fixed within the reel 130, and the other end of the cord can be sequentially passed through the second avoidance hole 126 and the second threading hole 1332 to be knotted and fixed within the reel 130.

In summary, the present disclosure proposes a winding device 100, wherein the winding device 100 comprises a housing 110, a fixing member 120, a reel 130 for winding the cord, a knob 140, a connecting member 150, a limiting component 160 and a fastener 170, wherein the limiting component 160 comprises a guide member 161 and an elastic member, and the fixing member 120 is connected to the housing 110 and is provided with a through cavity 121 with openings at both ends. An elastic arm 122 is provided at one end of the fixing member 120 away from the housing 110, and a check portion 1221 is provided at the circumferential edge of the elastic arm 122. The reel 130 is rotatable in the axial direction and disposed in the through cavity 121, and a toggle portion 131 is provided at one end of the reel 130 away from the housing 110. The side of the knob 140 facing the fixing member 120 is provided with a first clamping member 142 and a linkage portion 141 that cooperates with the check portion 1221. The connecting member 150 is connected to the end of the reel 130 away from the housing 110, wherein the outer periphery of the connecting member 150 is provided with a second clamping member 151 matching with the first clamping member 142, and a stepped hole 152 is provided in the inner periphery of the connecting member 150. An end of the guide member 161 close to the housing 110 is provided with a cooperation portion 1611 that matches with the toggle portion 131, and multiple guide grooves 1521 are circumferentially defined and formed along the inner wall of the hole with the largest aperture of the stepped hole 152. A guide clamping structure 1522 is formed between two adjacent guide grooves 1521. The elastic member abuts between the fixing member 120 and the knob 140. The guide member 161 is movably passed through the stepped hole 152, clamping slider 1612 is provided along the circumferential direction of the guide member 161, and the fastener 170 is passed through the guide member 161 to connect to the knob 140.

In the process of use, for example, when tightening the cord, it is only necessary to press the knob 140 once to squeeze and drive the guide member 161 to move synchronously to make the clamping slider 1612 slide out of the guide groove 1521, and to make the cooperation portion 1611 abut against the toggle portion 131, so as to rotate the guide member 161 in the stepped hole 152 under the action of the toggle portion 131, thereby making the clamping slider 1612 snapped with the guide clamping structure 1522. The first clamping member 142 is snapped with the second clamping member 151. At this time, the elastic member is compressed, and the linkage portion 141 is snapped with the check portion 1221, such that the knob 140 can only rotate in one of the clockwise direction or the counterclockwise direction, for example, the knob 140 can only rotate in the clockwise direction. In this way, the knob 140 can drive the reel 130 to rotate to tighten the cord. If it is necessary to release the cord, on the basis of the first pressing of the knob 140, the knob 140 is pressed again, and the cooperation portion 1611 abuts against the toggle portion 131, so as to rotate the guide member 161 in the stepped hole 152 under the action of the toggle portion 131. At the same time, using the reset elasticity generated by the elastic member being compressed, the clamping slider 1612 is slid from the clamping structure into the guide groove 1521, and the first clamping member 142 is separated from the second clamping member 151. At this time, the elastic member is reset, the linkage portion 141 is engaged with the check portion 1221, the reel 130 can rotate freely in the clockwise or counterclockwise direction, and the cord can be loosened from the reel 130. The cord can be tightened or loosened by sequentially cyclically operating and pressing the knob 140, that is, by pressing the knob 140, the cord can be rotated and tightened. The operation is simple and convenient, and avoids the technical difficulty in operation caused by pulling up the knob in the prior art.

In all of the examples illustrated and described herein, any specific values should be interpreted as merely exemplary and not as limitations, therefore, other examples of the exemplary embodiments can have different values.

It should be noted that similar labels and letters indicate similar items in the following drawings, so that once an item has been defined in one drawing, it does not need to be further defined and explained in subsequent drawings.

The above-described embodiments express only several embodiments of the present disclosure, which are described in a more specific and detailed manner, but cannot be construed as a limitation of the scope of the present disclosure. It should be pointed out that, for a person of ordinary skill in the art, a number of deformations and improvements can be made without departing from the conception of the present disclosure, all of which fall within the scope of protection of the present disclosure.

What is claimed is:

1. A winding device, comprising:

a housing;

a fixing member, connected to the housing, wherein the fixing member is provided with a through cavity with two openings at both ends, wherein an elastic arm is provided at one end of the fixing member away from the housing, and a circumferential edge of the elastic arm is provided with a check portion;

a reel for winding a cord, wherein the reel is rotatable in an axial direction and provided in the through cavity, and a toggle portion is provided at one end of the reel away from the housing; wherein the toggle portion is provided with a first toothed edge;

a knob, wherein a linkage portion and a first clamping member is provided on one side of the knob towards the fixing member, and the linkage portion cooperates with the check portion;

a connecting member, connected to the end of the reel away from the housing, wherein an outer circumference of the connecting member is provided with a second clamping member that matches the first clamping member; a stepped hole is provided on an inner periphery of the connecting member; multiple guide grooves are defined and formed along a circumferential direction of an inner wall of a hole with a largest aperture of the stepped hole, and a guide clamping structure is formed between two adjacent guide grooves; wherein the guide clamping structure is a step-like structure, and the step-like structure comprises a first stepped surface and a second stepped surface that are inclined surfaces;

a limiting component, wherein the limiting component comprises a guide member and an elastic member; one end of the guide member close to the housing is provided with a cooperation portion that matches the toggle portion; the elastic member abuts between the fixing member and the knob, the guide member is movably passed through the stepped hole, and a clamping slider is provided along a circumferential direction of the guide member; a plurality of oblique teeth are provided at intervals along the circumferential direction of the guide member, and the plurality of oblique teeth form the clamping slider; wherein the cooperation portion is provided with a second toothed edge that mates with the first toothed edge; wherein the first stepped surface and the second stepped surface are respectively in the same inclined direction as the oblique teeth; and a fastener, wherein the fastener is passed through the guide member to connect with the knob, wherein when the knob is being pressed, the clamping slider slides out of the guide groove, and the cooperation portion abuts against the toggle portion to rotate the guide member within the stepped hole under an action of the toggle portion, such that the clamping slider engages with the guide clamping structure, and the first clamping member engages with the second clamping member; and the knob is pressed again, so as to rotate the guide member within the stepped hole under the action of the toggle portion, such that the clamping slider slides from the clamping structure into the guide groove, and the first clamping member is separated from the second clamping member.

2. The winding device according to claim 1, wherein the first toothed edge and the reel are made by integral injection molding.

3. The winding device according to claim 1, wherein the reel is provided with a first clamping part at the end away from the housing, and one end of the connecting member close to the housing is provided with a second clamping part that is snapped with the first clamping part.

4. The winding device according to claim 1, wherein the fixing member is provided with a third clamping part at an end close to the housing, and the housing is provided with a fourth clamping part that is snapped with the third clamping part.

5. The winding device according to claim 1, wherein the elastic arm and the fixing member are made by integral injection molding.

6. The winding device according to claim 1, wherein the knob is provided with a mounting column protruding from one side of the knob close to the housing, wherein the mounting column is provided with a first mounting hole, the guide member is provided with a second mounting hole, and the fastener is sequentially passed through the second mounting hole and the first mounting hole, so as to tightly connect the guide member with the knob.

7. The winding device according to claim 1, wherein a first limiting portion is provided on an inner circumference of one end of the knob close to the housing, a second limiting portion that cooperates with the first limiting portion is provided on an outer circumference of one end of the fixing member away from the housing.

8. The winding device according to claim 1, wherein the reel comprises a reel and a disk body provided at both ends of the reel, a diameter of the disk body is larger than a diameter of the reel, the reel is respectively provided with a first threading hole and a second threading hole along an direction perpendicular to an axis of the reel, and the fixing member is provided with a first avoidance hole and a second avoidance hole, wherein the first avoidance hole is provided correspondingly to the first threading hole, and the second avoidance hole is provided correspondingly to the second threading hole.

9. The winding device according to claim 1, wherein the reel comprises a reel and a disk body provided at both ends of the reel, a diameter of the disk body is larger than a diameter of the reel, the reel is respectively provided with a first threading hole and a second threading hole along an direction perpendicular to an axis of the reel, and the fixing member is provided with a first avoidance hole and a second avoidance hole, wherein the first avoidance hole is provided correspondingly to the first threading hole, and the second avoidance hole is provided correspondingly to the second threading hole.

10. The winding device according to claim 1, wherein the reel comprises a reel and a disk body provided at both ends of the reel, a diameter of the disk body is larger than a diameter of the reel, the reel is respectively provided with a first threading hole and a second threading hole along an direction perpendicular to an axis of the reel, and the fixing member is provided with a first avoidance hole and a second avoidance hole, wherein the first avoidance hole is provided correspondingly to the first threading hole, and the second avoidance hole is provided correspondingly to the second threading hole.

11. The winding device according to claim 2, wherein the reel comprises a reel and a disk body provided at both ends of the reel, a diameter of the disk body is larger than a diameter of the reel, the reel is respectively provided with a first threading hole and a second threading hole along an direction perpendicular to an axis of the reel, and the fixing member is provided with a first avoidance hole and a second avoidance hole, wherein the first avoidance hole is provided correspondingly to the first threading hole, and the second avoidance hole is provided correspondingly to the second threading hole.

12. The winding device according to claim 3, wherein the reel comprises a reel and a disk body provided at both ends of the reel, a diameter of the disk body is larger than a diameter of the reel, the reel is respectively provided with a first threading hole and a second threading hole along an direction perpendicular to an axis of the reel, and the fixing member is provided with a first avoidance hole and a second avoidance hole, wherein the first avoidance hole is provided correspondingly to the first threading hole, and the second avoidance hole is provided correspondingly to the second threading hole.

13. The winding device according to claim 4, wherein the reel comprises a reel and a disk body provided at both ends of the reel, a diameter of the disk body is larger than a diameter of the reel, the reel is respectively provided with a first threading hole and a second threading hole along an direction perpendicular to an axis of the reel, and the fixing member is provided with a first avoidance hole and a second avoidance hole, wherein the first avoidance hole is provided correspondingly to the first threading hole, and the second avoidance hole is provided correspondingly to the second threading hole.

14. The winding device according to claim 5, wherein the reel comprises a reel and a disk body provided at both ends of the reel, a diameter of the disk body is larger than a diameter of the reel, the reel is respectively provided with a first threading hole and a second threading hole along an direction perpendicular to an axis of the reel, and the fixing member is provided with a first avoidance hole and a second avoidance hole, wherein the first avoidance hole is provided correspondingly to the first threading hole, and the second avoidance hole is provided correspondingly to the second threading hole.

15. The winding device according to claim 6, wherein the reel comprises a reel and a disk body provided at both ends of the reel, a diameter of the disk body is larger than a diameter of the reel, the reel is respectively provided with a first threading hole and a second threading hole along an direction perpendicular to an axis of the reel, and the fixing member is provided with a first avoidance hole and a second avoidance hole, wherein the first avoidance hole is provided correspondingly to the first threading hole, and the second avoidance hole is provided correspondingly to the second threading hole.

16. The winding device according to claim 7, wherein the reel comprises a reel and a disk body provided at both ends of the reel, a diameter of the disk body is larger than a diameter of the reel, the reel is respectively provided with a first threading hole and a second threading hole along an direction perpendicular to an axis of the reel, and the fixing member is provided with a first avoidance hole and a second avoidance hole, wherein the first avoidance hole is provided correspondingly to the first threading hole, and the second avoidance hole is provided correspondingly to the second threading hole.

* * * * *